US008419446B2

(12) United States Patent
Fan

(10) Patent No.: US 8,419,446 B2
(45) Date of Patent: Apr. 16, 2013

(54) ELECTRICAL CONNECTOR HAVING CONTACTS WITH SOLDER PORTION POINTING OPPOSITE DIRECTIONS

(75) Inventor: Chia-Wei Fan, Tu-Cheng (TW)

(73) Assignee: Hon Hai Precision Ind. Co., Ltd, New Taipei (TW)

( * ) Notice: Subject to any disclaimer, the term of this patent is extended or adjusted under 35 U.S.C. 154(b) by 400 days.

(21) Appl. No.: 12/702,292

(22) Filed: Feb. 9, 2010

(65) Prior Publication Data

US 2010/0216344 A1 Aug. 26, 2010

(30) Foreign Application Priority Data

Feb. 23, 2009 (TW) ..... 98202660 U

(51) Int. Cl.
*H01R 12/00* (2006.01)

(52) U.S. Cl.
USPC ..... 439/83; 439/862

(58) Field of Classification Search ..... 439/71, 439/83, 862
See application file for complete search history.

(56) References Cited

U.S. PATENT DOCUMENTS

| | | | | |
|---|---|---|---|---|
| 4,614,387 | A * | 9/1986 | Hartl | 439/70 |
| 6,530,790 | B1 | 3/2003 | McNamara et al. | |
| 6,877,998 | B1 * | 4/2005 | Kim et al. | 439/108 |
| 7,001,197 | B2 | 2/2006 | Shirai et al. | |
| 7,074,048 | B2 * | 7/2006 | Liao et al. | 439/66 |
| 7,264,486 | B2 * | 9/2007 | Ma | 439/83 |

* cited by examiner

*Primary Examiner* — Neil Abrams
*Assistant Examiner* — Travis Chambers
(74) *Attorney, Agent, or Firm* — Wei Te Chung; Ming Chieh Chang

(57) ABSTRACT

An electrical connector includes an insulative housing with a plurality of passageways arranged in a matrix. A contact includes a base for securing the contact in the passageway, a spring portion and a soldering portion extending from the base. The soldering portions of the contacts laid in a row of the passageways are alternately arranged toward two opposite sides of the base to form two rows. Such array of soldering portions of the contact can improve contact density.

20 Claims, 6 Drawing Sheets

ELECTRICAL CONNECTOR HAVING CONTACTS WITH SOLDER PORTION POINTING OPPOSITE DIRECTIONS

BACKGROUND OF THE INVENTION

1. Field of the Invention

The present invention relates to an electrical connector, and more particularly to an electrical connector having contacts arranged in a same row having solder portions pointing to opposite directions.

2. Description of Related Art

Electrical connector is typically used for electrically connecting an electronic package to a printed circuit board. Such electrical connector usually has a plurality of contacts arranged in a matrix, which is made by stamping and comprises a retention portion, a mating portion extending upwardly from the retention portion for engaging with the electronic package, and a soldering portion bent substantially perpendicular to the retention portion toward a same direction regarding with the retention portion. Each soldering portion includes a solder ball to have it soldered to the printed circuit board. In order to avoid neighboring solder balls to contact with each other during reflowing the electrical connector to the printed circuit board, the contacts must be kept in predetermined pitches.

To get a better contact density, an improved contact arrangements for the electrical connector is required.

SUMMARY OF THE INVENTION

An object of the present invention is to provide an electrical connector with solder portions alternatively and oppositely arranged so as to shorten the pitch between adjacent contacts.

To achieve the aforementioned object, an electrical connector comprises an insulative housing with a plurality of passageways and a plurality of contacts each including a base received in the passageway. A spring portion extends upwardly from the base and a soldering portion extends downwardly from the base. The soldering portion has a same pitch with each of all surrounding neighboring soldering portions.

To further achieve the aforementioned object, an electrical connector comprises an insulative housing with a plurality of passageways and a plurality of contacts received in the passageways. Each contact includes a spring portion and a soldering portion both extending from a base thereof securing the contact in the passageway. The spring portions received in the insulative housing is arranged by a same way, and the soldering portions located in a same row of the passageways are pointing in two opposite directions of the base and staggered with each other.

Other objects, advantages and novel features of the invention will become more apparent from the following detailed description of a preferred embodiment when taken in conjunction with the accompanying drawings.

DETAILED DESCRIPTION OF THE INVENTION

The electrical connector is used to electrically connect with an electronic package and a printed circuit board. Conventional electrical connector substantially comprises an insulative housing, a plurality of contacts received in the insulative housing, a stiffener surrounding the insulative housing, a load plate and a lever mounted to the stiffener for locking the electronic package in the insulative housing. In present invention, the electrical connector is similar to the conventional electrical connector, and the differences are the contact configuration and the contact arrangement in the insulative housing. The following detail describes the configuration and arrangement of the contacts and omits another similar parts of the electrical connector, such as disclosed in U.S. Pat. No. 7,001,197 issued to Shirai et al. on Feb. 21, 2006. The specification is herein incorporated for reference.

Figure 1:
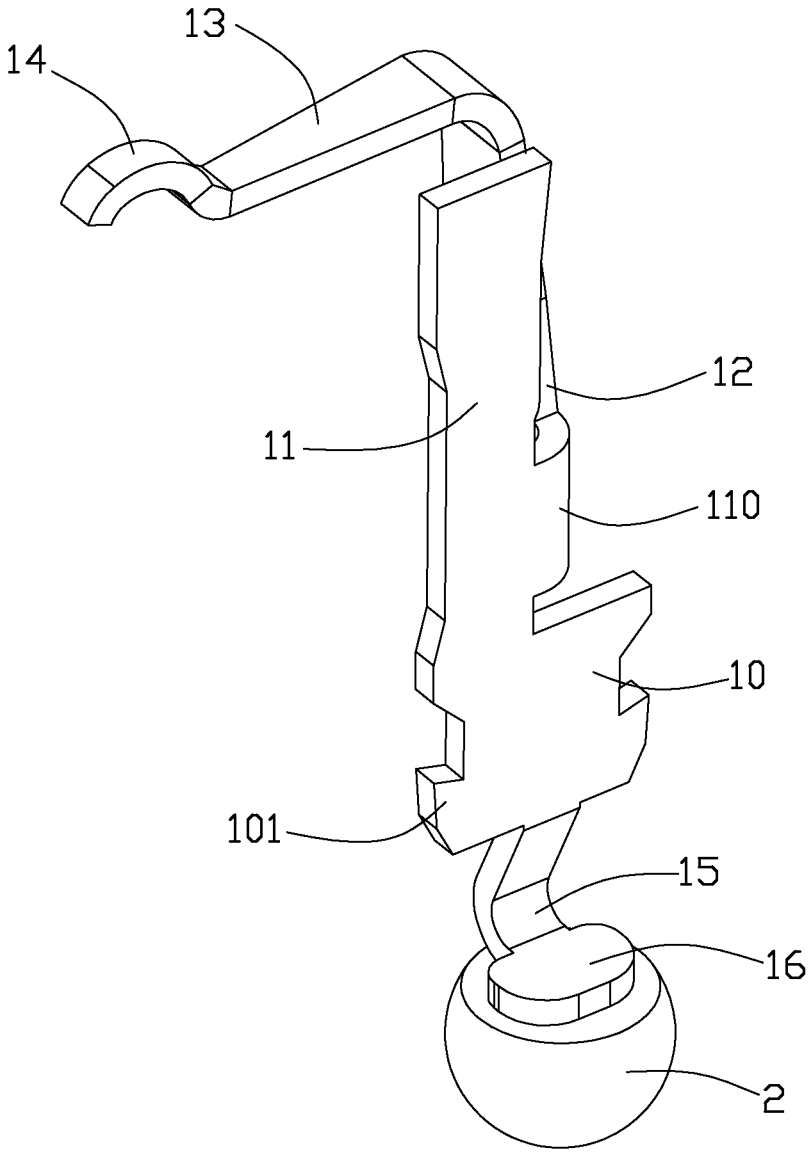
FIG. 1 is a perspective view of a contact with a solder ball in accordance with the present invention.
Figure 2:
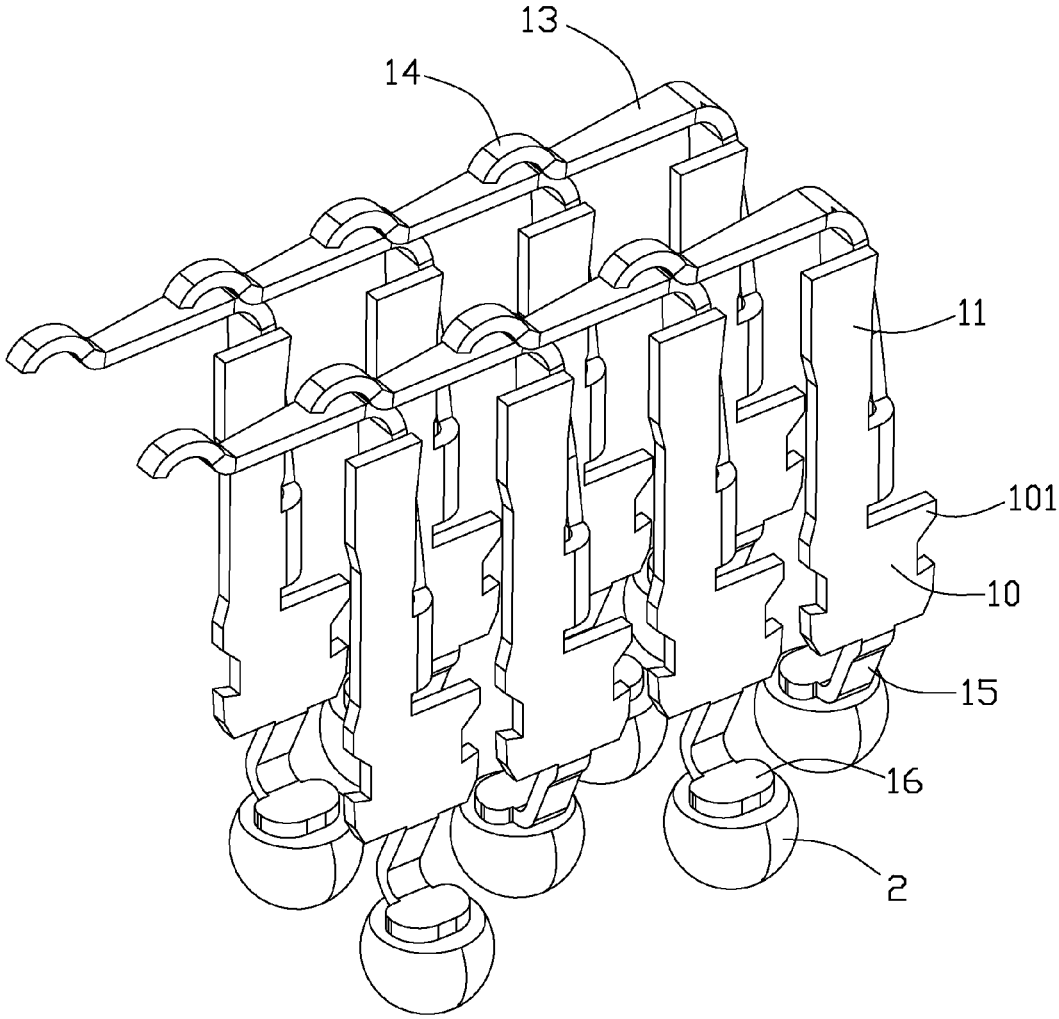
FIG. 2 is a sketch, perspective view, showing two rows of contacts with solder balls.
Figure 3:
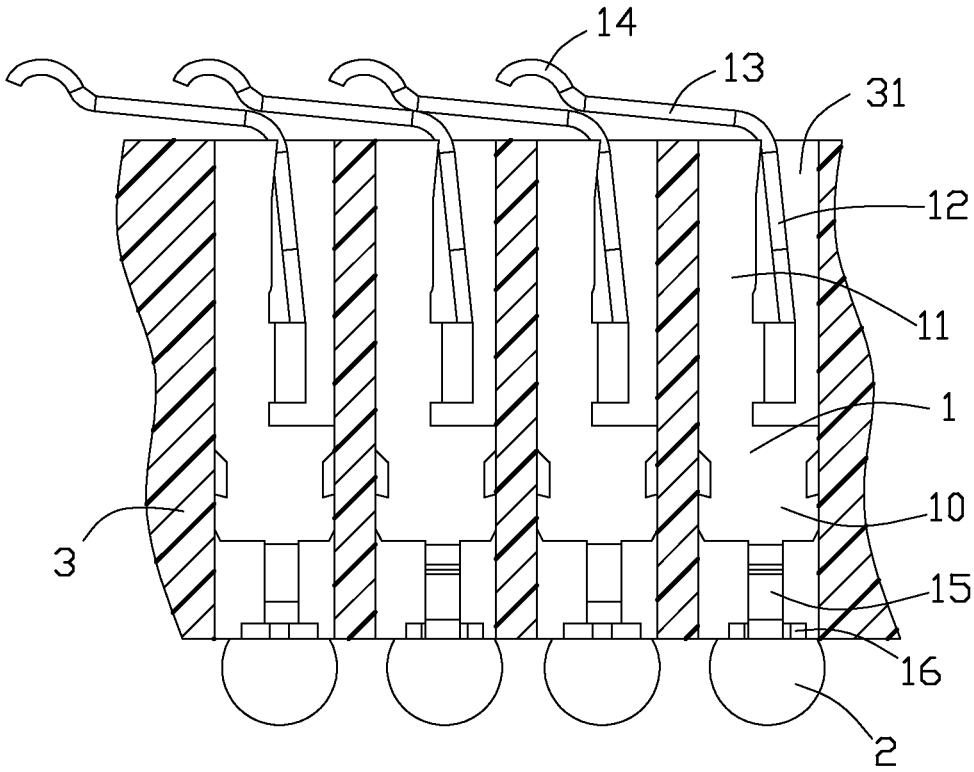
FIG. 3 is a cross-sectional, sketch view, showing the contacts received in the insulative housing.
Figure 4:
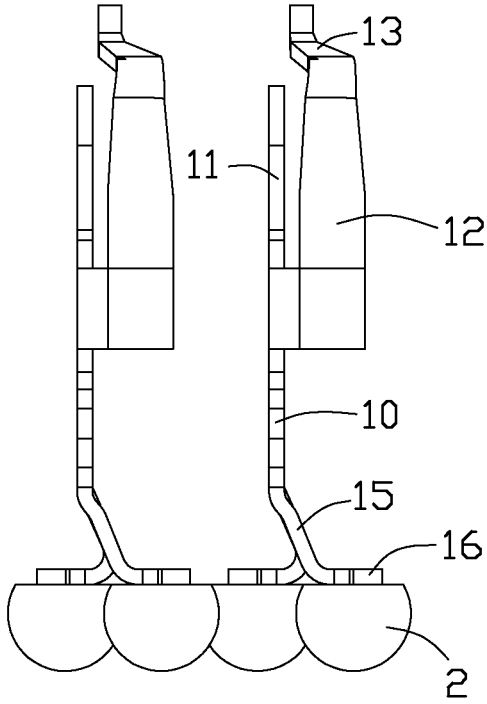
FIG. 4 is a side view of the contacts shown in FIG. 2.

Referring to FIG. 1, the contact 1 is made by stamping and includes a base received in the insulative housing 3. The base comprises a planar retention portion 10 and a planar connecting portion 11 extending upwardly from the retention portion 10 and being coplanar with the retention portion 10. The retention portion 10 is wider than the connecting portion 11, and a plurality of barbs 101 are disposed at two sides of the retention portion 10 and at one side of the connecting portion 11 for securing the contact 1 in a passageway 31 of the insulative housing 3. A spring portion 12 connects with the connecting portion 11 by a curvilinear portion 110 and is located at a side of the retention portion 10 with an angle therebetween. The spring portion 12 can also directly extend from the retention portion 10. The spring portion 12 includes a horizontal portion 13 substantially horizontally extending and a curvilinear mating portion 14 disposed at a free end of the horizontal portion 13. A soldering portion 16 is perpendicular to the retention portion 10 and connected with the retention portion 10 by an inclined necking portion 15. The necking portion 15 is disposed at a side of the spring portion 12.

Referring to FIGS. 2-6, showing various views of partial contacts 1. The contacts 1 are received in the passageways 31 of the insulative housing 3. Each passageway 31 receives one contact 1, and one solder ball 2 is disposed at a bottom surface of the soldering portion 16. The contacts 1 of the present invention have two types of soldering portions 16, a first type of soldering portion 16 is forwardly bent from the necking portion 15 and located at a same side of the retention portions 10 with the spring portion 12, and a second type of soldering portion 16 is backwardly bent from the necking portion 15 and located at an opposite side of the retention portions 10 relative to the spring portion 12. The contacts 1 are arrayed in the insulative housing 3 and are set as following: in a same row of the passageways 31, all the retention portions 10 are located in a vertical plane, the soldering portions 16 are arranged in two rows by bending toward two opposite sides of the retention portions 10 in turn, and alternately; the soldering portions 16 of the contacts 1 in a line which is perpendicular to the row are bent toward a same direction; the spring portions of the contacts arranged in the same row are disposed in a row corresponding to the soldering portions are divided into two rows.

Figure 5:
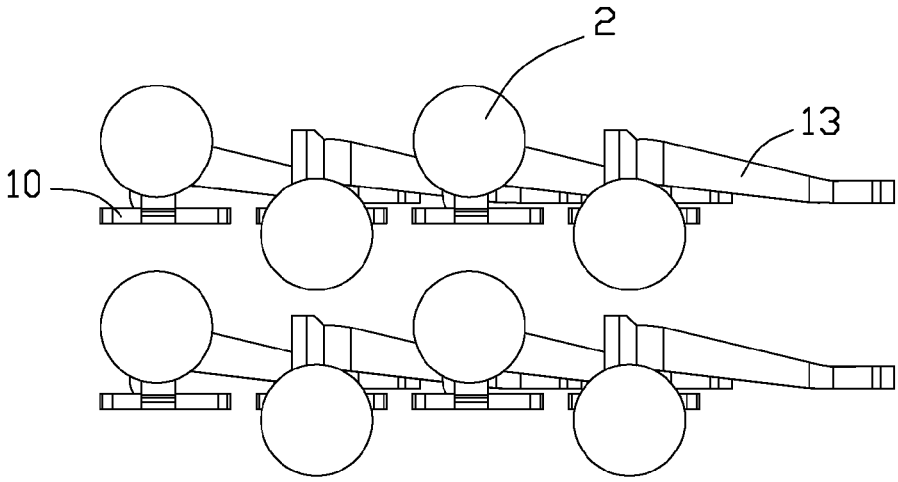
FIG. 5 is a bottom view of the contacts shown in FIG. 2.
Figure 6:
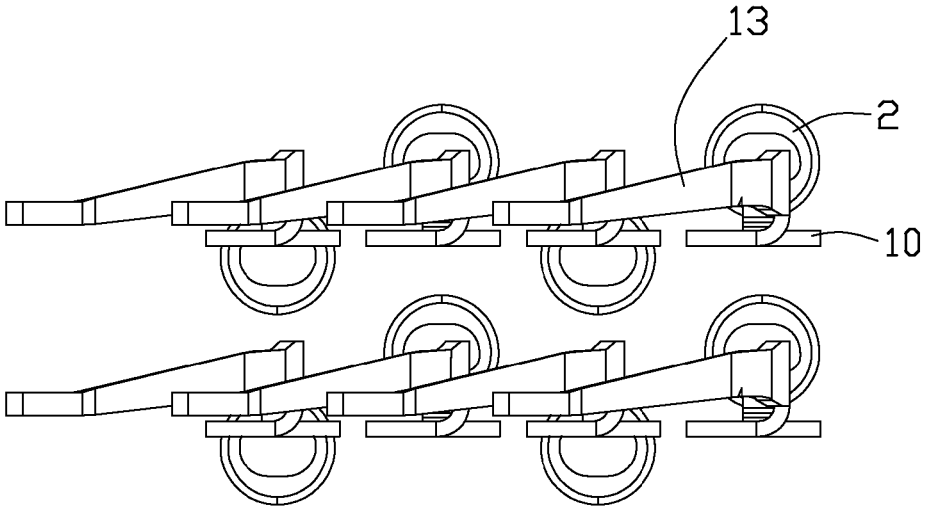
FIG. 6 is a top view of the contacts shown in FIG. 2.

The following contents is detailed description about the principle of the present electrical connector how to get a high contacts density. Referring to FIG. 5, the first and the second type of soldering portions 16 alternates with each other in a same row, two neighboring solder balls 2 have a smallest pitch in a vertical direction therebetween so as to prevent short-circuiting, what's more important is that a distance between the neighboring solder balls in a horizontal direction is smaller than the smallest pitch such that more contacts 1 can be arranged relative to the conventional electrical connector in a same area. On this condition, each soldering portion has an equal pitch with each of all surrounding neighboring soldering portions; the spring portions 12 of the contacts 1 arranged in the same row are disposed in a row corresponding to the soldering portions 16 are divided into two rows, and each spring portion 16 extends upon a neighboring passageway 31 in a same row.

Although the present invention has been described with reference to particular embodiments, it is not to be construed as being limited thereto. Various alterations and modifications can be made to the embodiments without in any way departing from the scope or spirit of the present invention as defined in the appended claims.

What is claimed is:

1. An electrical connector comprising:

an insulative housing with a plurality of passageways arranged in rows and columns perpendicular to each other;

a plurality of contacts each received in one passageway, each contact including a base received in the passageway, a spring portion extending upwardly from the base and a soldering portion extending downwardly from the base, at least one soldering portion having a same pitch with three soldering portions at one neighboring row.

2. The electrical connector as claimed in claim 1, wherein the contacts arranged in a same row of passageways have two type of soldering portions, a first type of the soldering portion is forwardly bent from the base and a second type of the soldering portion is backwardly bent from the base.

3. The electrical connector as claimed in claim 2, wherein the first type of the soldering portion is staggered with the second type of the soldering portion, and the contacts in another row of the passageways are the same arranged.

4. The electrical connector as claimed in claim 3, wherein the spring portions of the contacts arranged in the same row are disposed in a row corresponding to the soldering portions are divided into two rows.

5. An electrical connector comprising:

an insulative housing with a plurality of passageways arranged in rows and columns perpendicular to each other;

and a plurality of contacts, each including a spring portion and a soldering portion both extending from a base thereof securing the contact in the passageway, the spring portions received in the insulative housing being arranged by a same way, and the soldering portions with solder balls located in a same row of the passageways being pointing in two opposite directions of the base and being staggered with each other; and wherein every three neighboring solder balls in both the rows and the columns are arranged with an equilateral triangle configuration from a bottom view.

6. The electrical connector as claimed in claim 5, wherein the soldering portions of contacts in a column are bent toward a same direction.

7. The electrical connector as claimed in claim 5, wherein the electrical connector has two types of contacts, and a first type of contact having a soldering portion being forwardly bent from the base and located at a same side of the base with the spring portion, and a second type of contact having a soldering portion being backwardly bent from the base and located at an opposite side of base relative to the spring portion thereof.

8. The electrical connector as claimed in claim 5, wherein all the bases located in a same row of passageways are arranged in a vertical plane.

9. The electrical connector as claimed in claim 5, wherein the base and the soldering portion connect by an inclined necking portion, the necking portion is disposed at a same side with the spring portion.

10. An electrical connector comprising:

a plurality of contact arranged in matrix with at least densely disposed two rows and two columns respectively defining a row direction and a column direction perpendicular to each other;

each of said contacts defining a retention section with an upper contacting section with a contacting apex thereof and a lower soldering section with a solder ball thereof; wherein the contacting apexes of the closely neighboring contacts are arranged in said row direction and said column direction, while the solder balls of the closely neighboring contacts in the same row are arranged in an oblique direction angled with regard to both said row direction and said column direction.

11. The electrical connector as claimed in claim 10, wherein the solder balls of the closely neighboring contacts in each column are arranged along the column direction, similar to the corresponding contacting sections.

12. The electrical connector as claimed in claim 10, wherein in each row of contacts, the solder balls of the closely neighboring contacts are alternately offset from one another under a zigzag manner in said row direction.

13. The electrical connector as claimed in claim 10, wherein in each row some of the solder balls of the contacts are closer to those of the contacts in the neighboring row than those of others in the same row, and in a side view said some of the solder balls are spaced from those in the neighboring row and those of the others in the same row essentially with a same distance.

14. The electrical connector as claimed in claim 10, wherein the neck section of the closely neighboring contacts along the column direction and the row direction, extend in a same oblique direction in a side view.

15. The electrical connector as claimed in claim 10, wherein the solder balls of the closely neighboring contacts in each row are alternately symmetrically arranged with one another, in a top view, with regard to a center line defined by the corresponding contacting sections of the contacts in said row.

16. The electrical connector as claimed in claim 15, wherein in each row the retention sections of the contacts are aligned with one another in said row direction while each retention section is offset from the center line of the corresponding contact with a distance in the column direction.

17. The electrical connector as claimed in claim 16, wherein each of the contacts further includes a neck section between the soldering section and the retention section, and in each row the neck section extends toward the center line in said column direction.

18. The electrical connector as claimed in claim 10, wherein the contacting sections of every four closely neighboring contacts in both said row and column directions are arranged with a rectangular configuration in a top view while the solder balls of the every four closely neighboring contacts in both said row and said column directions are arranged with a parallelogram shape in said top view.

19. The electrical connector as claimed in claim 18, wherein said parallelogram shape is essentially a diamond shape.

20. The electrical connector as claimed in claim 18, wherein the solder balls of every three closely neighboring contacts arranged in said two rows and said two columns commonly define a equilateral triangle.

* * * * *